US006024149A

United States Patent [19]

Bernhard et al.

[11] Patent Number: 6,024,149

[45] Date of Patent: Feb. 15, 2000

[54] LABELING APPARATUS

[75] Inventors: Juergen Bernhard, Empfingen; Sebastian Ruff, Grosselfingen; Willi Sautter, Rosenfeld-Tabingen, all of Germany

[73] Assignee: Bizerba GmbH & Co. KG, Baligen, Germany

[21] Appl. No.: 09/133,884

[22] Filed: Aug. 13, 1998

Related U.S. Application Data

[63] Continuation of application No. PCT/EP96/05479, Dec. 7, 1996.

[30] Foreign Application Priority Data

Feb. 21, 1996 [DE] Germany ..... 196 06 199

[51] Int. Cl.[7] ..... B65C 9/28

[52] U.S. Cl. ..... 156/497; 156/542; 156/DIG. 38

[58] Field of Search ..... 156/247, 249, 156/497, 542, DIG. 38

[56] References Cited

U.S. PATENT DOCUMENTS

| | | | |
|---|---|---|---|
| 3,379,466 | 4/1968 | Hughes . | |
| 3,645,832 | 2/1972 | Sauer . | |
| 3,888,725 | 6/1975 | French | 156/DIG. 38 X |
| 3,984,277 | 10/1976 | French et al. | 156/497 X |
| 4,046,613 | 9/1977 | Kucheck et al. | 156/249 |
| 4,392,913 | 7/1983 | Baumli | 156/497 X |
| 4,526,648 | 7/1985 | Tochtermann | 156/497 |
| 4,556,443 | 12/1985 | Moya | 156/497 X |
| 4,581,094 | 4/1986 | Sato | 156/497 X |
| 4,612,079 | 9/1986 | Ostrow | 156/497 |
| 4,680,082 | 7/1987 | Kearney | 156/497 |
| 5,470,420 | 11/1995 | Yokajty | 156/542 X |
| 5,753,072 | 5/1998 | Taylor | 156/542 X |
| 5,853,530 | 12/1998 | Allen | 156/542 X |
| 5,885,406 | 3/1999 | Tiefel | 156/542 |

FOREIGN PATENT DOCUMENTS

| | | |
|---|---|---|
| 2 412 691 | 9/1974 | Germany . |
| 34 07 837 | 9/1984 | Germany . |
| 1 402 179 | 8/1975 | United Kingdom . |

*Primary Examiner*—Curtis Mayes
*Attorney, Agent, or Firm*—Barry R. Lipsitz; Ralph F. Hoppin

[57] ABSTRACT

In order to make it possible to change over quickly and easily to different label sizes and shapes in a labeling apparatus for the application of labels to packages and goods comprising a label dispensing device and an air-blast labeling device, wherein the label dispensing device supplies labels individually from a supply to the air-blast labeling device and wherein the air-blast labeling device has an underpressure chamber with a suction plate having a plurality of openings for drawing in the labels supplied by the label dispensing device, a source of compressed air with a compressed-air distributor which has an air-blast plate arranged adjacent the suction plate and provided with a plurality of openings, as well as a compressed-air pulse generator which directs a blast of compressed air from the source of compressed air through the air-blast plate of the compressed-air distributor and through the suction plate against the label held by the suction plate in order to release this from the suction plate and convey it to the package or article, it is suggested that the air-blast labeling device comprise between the suction plate and the air-blast plate a slide element which is mounted for displacement in such a manner that in various adjustment positions it covers or releases variable surface areas of the suction and air-blast plates for the passage of air drawn in or expelled.

22 Claims, 3 Drawing Sheets

LABELING APPARATUS

The present application is a continuation of International Patent Application No. PCT/EP96/05479, filed Dec. 7, 1996, designating the United States, the entire specification of which is incorporated herein by reference.

FIELD OF THE INVENTION

The invention relates to a labeling apparatus for the application of labels to packages and goods comprising a label dispensing device and an air-blast labeling device, wherein the label dispensing device supplies labels individually from a supply to the air-blast labeling device and wherein the air-blast labeling device comprises

- a low-pressure chamber with a suction plate having a plurality of openings for drawing in the labels supplied by the label dispensing device,
- a source of compressed air with a compressed-air distributor having an air-blast plate arranged adjacent the suction plate and provided with a plurality of openings,
- as well as a compressed-air pulse generator directing a blast of compressed air from the source of compressed air through the air-blast plate of the compressed-air distributor and through the suction plate against the label held by the suction plate in order to release this from the suction plate and convey it to the package or article.

BACKGROUND OF THE INVENTION

Labeling apparatuses are used for applying labels with product information, advertising communications etc. to packages and goods. The labels used for this purpose are mostly self-adhesive labels which adhere, for example, to a backing strip and are wound together with this on a label dispensing roller of a label dispensing device. The label is separated from the backing strip as a result of a strong deflection about a removal bar and dispensed to the label receiving surface of a so-called air-blast labeling device. The label is first of all drawn in by means of underpressure and subsequently blown automatically onto a package or article conveyed passed it with a blast of compressed air.

The labels of the various types of goods are very different in their size and shape depending on the information content and advertising design.

It is known from U.S. Pat. No. 2,787,104 to adapt a suction head for holding a label in a labeling machine to the length of the label in that a slide element in the form of a plug is inserted to varying depths into a suction chamber so that the suction bores not required are covered.

Known labeling apparatuses operate with air-blast labeling devices, in which a label suction or receiving plate provided with holes or slots is used at the same time for drawing in and blowing the label onto the article. A continuous underpressure is generated in the air-blast labeling housing and this is switched over to compressed air for a short time via a valve, for blowing the label onto the package. The blast of air through the holes or slots of the receiving plate which is thereby generated causes the label to fly away in the direction of the package. This simple embodiment does, however, have the disadvantage that during the processing of labels which are smaller than the receiving plate the degree of efficiency of the blow-on function onto the package deteriorates. The openings not covered by the label lead to a loss in pressure energy during the switchover to the pulse of compressed air. This means that the blow-on energy and thus the quality of adhesion on the package is reduced. Moreover, the flight path of the label is influenced negatively by the air jets of the openings located outside the label surface.

DE 24 12 691 discloses an embodiment which eliminates the above disadvantages by having separate underpressure and pressure chambers present in the air-blast labeling housing.

An additional air-blast apertured plate is arranged above the suction plate at a distance therefrom and a pressure chamber is located above the apertured plate. For adaptation to the size and shape of the labels the air-blast openings in the air-blast apertured plate can be closed with screws or alternatively provided with long screw-in nozzles which bridge the space between air-blast apertured plate and suction plate and act on the label surface during the switchover to compressed air.

Air-blast openings can be covered or left open with an apertured mask usable above the air-blast apertured plate depending on the aperture pattern. The changeover to other label sizes is, however, complicated and time-consuming with this construction because a change of the apertured mask is necessary in this respect and a separate apertured mask must be kept ready for each label shape.

OBJECTS OF THE INVENTION

The object underlying the invention is to create a user-friendly labeling apparatus which allows a quick changeover to different label sizes and shapes and with which, adjustable for the different label sizes, as straight a label flight path as possible is attained at a high traveling speed with as low a pressure energy consumption as possible. In addition, the necessity of a supply of apertured masks for each label shape is intended to be avoided.

SUMMARY OF THE INVENTION

This object is accomplished in accordance with the invention, in the labeling apparatus for the application of labels to packages and goods comprising a label dispensing device and an air-blast labeling device, wherein the label dispensing device supplies labels individually from a supply to the air-blast labeling device and wherein the air-blast labeling device comprises

- a low-pressure chamber with a suction plate having a plurality of openings for drawing in the labels supplied by the label dispensing device,
- a source of compressed air with a compressed-air distributor having an air-blast plate arranged adjacent the suction plate and provided with a plurality of openings,
- as well as a compressed-air pulse generator directing a blast of compressed air from the source of compressed air through the air-blast plate of the compressed-air distributor and through the suction plate against the label held by the suction plate in order to release this from the suction plate and convey it to the package or article, said air-blast labeling device comprising between the suction plate and the air-blast plate a slide element mounted for displacement in such a manner that in various adjustment positions it covers or releases variable surface areas of the suction and air-blast plates for the passage of air drawn in or expelled.

As a result of the arrangement of a slide element between the air-blast plate and the suction plate, a very simple and rapid changeover to the altered label size is possible by means of a simple adjustment of the slide element which, in the altered position, releases an altered surface area of the air-blast plate as well as the suction plate which corresponds to the label size.

Thus, the air-blast energy of the air-blast labeling device or rather its source of compressed air is concentrated on the blast nozzles which are located within the surface area of the suction plate covered by the label, i.e. for generating the same label traveling speed the pressure energy, formed by the volume of air of the pressure storage means and the pressure built up, can be reduced in the case of smaller labels.

Furthermore, transverse flows of air and unfavorable turbulences, caused by blast nozzles located outside the contour of the label and their jets of air, are avoided.

In a preferred embodiment it is provided for the slide element to be displaceable in label dispensing direction, whereby the extension of the surface areas of the suction and air-blast plates in label transporting direction can be adapted first of all.

The slide element itself is preferably designed as a flat slide, wherein its thickness corresponds to the height of the space between suction plate and air-blast plate. This means that an effective sealing of the openings in the suction plate and the openings or nozzles in the air-blast plate which are not required is obtained in a simple manner.

For simple adjustment and, where necessary, fixing in position, the slide element can be adjusted in label dispensing direction by means of a handle arranged below the suction plate, wherein a spring element acting as a friction brake preferably acts against the self-acting displacement of the slide element. Other fixing means for the slide element can, of course, likewise be used.

For the simple adaptation of the surface area of the suction plate and the air-blast plate, respectively, required by the label size, the source of compressed air, including the air-blast plate, is made adjustable transversely to the label dispensing direction. This means that the surface area acted upon with underpressure and compressed air, respectively, can be adapted exactly to the label size together with the slide displaceable longitudinally in label dispensing direction.

In addition, the flight path of the labels can be corrected, where necessary, when, for example, corrections of the flows of air acting on the label are necessary on account of curves in the label due to the winding onto the dispensing roller or on account of an off-center position of the blast nozzles. These corrections can be realized very simply by means of the adjustment of the slide element and thus an exactly determinable placing of the label on the package or article is attained.

A preferred possibility for the defined adjustment of the position of the source of compressed air, together with air-blast plate, is provided, for example, by a threaded spindle which is adjustable via a turning knob located externally on the air-blast labeling device, wherein the set label width is preferably made readable at a scale arranged externally on the air-blast labeling device.

The same may be achieved for the adjustment position of the slide element in label dispensing direction when the slide element is provided with an indicator which is visible from the outside and travels along a scale together with the slide element.

This means that adjustment to the desired label size can be made from the start in a very simple manner by hand and without the necessity of carrying out label tests.

Alternatively, the adjustment of the slide element and/or of the source of compressed air can also take place by way of a motor, in particular, using a stepping motor.

The adjustment position data of the slide element and/or of the source of compressed air may be stored for each article in a data memory based on articles, wherein these stored data correspond to the label size to be used (for example, length×width). With the entry of a new article or a new product or changed package, the stored adjustment positions of the slide element and/or of the source of compressed air can be approached automatically in accordance with the new position data. This means that the operator need only enter the article number when the article to be labeled is changed and the labeling apparatus automatically changes over to the predetermined label size for this article.

Since a good sealing of the blast nozzles or rather openings of the air-blast plate outside the areas covered by the labels is, in particular, of primary importance, the slide element will abut sealingly on the air-blast plate preferably under tension. This avoids the formation of spaces between the slide element and the air-blast plate due to the blast of compressed air, with uncontrolled flows of air escaping via these spaces. Moreover, this ensures that the entire compressed-air energy reaches the label and does not escape unused via edge regions, leakages etc.

The openings in the air-blast plate are preferably designed as blast nozzles and aligned with the openings in the suction plate. In this respect, the width of the openings in the suction plate is preferably selected to be larger than the diameter of the blast nozzles so that the conical air jets formed by the blast nozzles can essentially pass unhindered through the suction plate and thus a linear flight of the labels from the suction plate to the article to be labeled is ensured.

A particularly homogeneous distribution of compressed air is obtained when a fine-meshed screen is either arranged between the slide element and the air-blast plate or, however, the fine-meshed screen is provided on the surface of the air-blast plate remote from the slide element. The fine-meshed screen will thereby cover all the openings or rather blast nozzles in the air-blast plate. The mesh screen spacing of the fine-meshed screen is preferably selected such that this is at the most one third of the diameter of the blast nozzles or the width of the openings.

A particularly non-critical transition between the label dispensing device and the air-blast labeling device, i.e. a particularly reliable transfer of the label from the dispensing device to the air-blast device is obtained when the side face of the suction plate pointing towards the label dispensing device is designed as an inclined sliding surface for the labels. The labels dispensed from the label dispensing device slide with their upper side along the inclined sliding surface which preferably extends beyond the suction plane and then forms a peeling edge. Directly behind the peeling edge the suction effect of the suction plate of the air-blast labeling device then becomes effective and this tilts the label about the peeling edge and aids the complete detachment of the label from the backing strip.

The inclined sliding surface is preferably provided with a plurality of ribs extending in label dispensing direction, these ribs preferably continuing as far as the peeling edge. As a result of the ribs, which can, for example, have the shape of saw teeth, adhesive residues, which partially adhere to the outer edges of the labels as a result of production, are prevented from settling on the inclined sliding surface and leading to malfunctions.

In order to facilitate the abutment of the labels supplied from the label dispensing device to the air-blast labeling device on the suction plate, a support air pipe can be arranged beneath the label suction plane and this is preferably equipped with fine blast nozzles, with the aid of which a flow of air can be directed towards the suction plate. The support air pipe is preferably supplied with compressed air via a valve only as required, i.e. when a label is transferred from the dispensing device to the air-blast labeling device. The flow of air causing the label to abut on the suction plate is to be switched off, in particular, before the pressure pulse for conveying the label from the suction plate to the package to be labeled takes place.

Although the labeling apparatus described above is excellent for use with an abundance of known labeling materials, problem cases do occur when the complete detachment of the labels from the backing strip requires a certain mechanical assistance. For these cases it may be provided for a movable ejector to be arranged between a label removal bar, about which the backing strip is deflected with a small radius, and the suction plate, a short thrusting movement at right angles to the label dispensing direction being carried out with this ejector upon termination of the label removal procedure. This certainly leads to a reliable detachment of the label ends from the backing strip even in the problematic cases.

Preferred labeling apparatuses comprise a source of compressed air, in which a pressure storage chamber is provided directly adjoining the air-blast plate and this can be ventilated abruptly via a valve. In this respect, it is particularly advantageous for the entire compressed-air energy to be able to act on the label over a relatively short space of time and thus a type of delta-shaped pressure jump be achieved. The pressure storage chamber has the advantage that the pressure storage chamber can be filled to the prescribed pressure value at a slower time scale than the evacuation of the pressure storage chamber and so the pressure storage means can be filled using less power.

The pressure storage chamber is preferably produced in one piece with a valve member for the ventilation valve and the distributor chamber.

A particularly simple but effective construction consists in the fact that the pressure storage chamber contains an integrated membrane chamber which contains a pot-shaped membrane. The pot-shaped membrane seals an air-injection bore leading to the blast nozzles during the filling of and maintaining the pressure in the pressure storage chamber and releases the air-injection bore and thus the connection between pressure storage chamber and blast nozzles during the switching over of the valve.

The following advantages may be achieved, in particular, by means of the invention:

- a changeover of the label size can be carried out quickly and simply.
- the air-blast energy is concentrated on the blast nozzles which are located within the label surface, i.e. at the same label traveling speed the pressure energy, formed by the air volume of the pressure storage means and the pressure built up, can be decreased for smaller labels.
- transverse flows of air and unfavorable turbulences of the blast nozzles located outside the contour of the label (cf. FIGS. 7 and 8) and unfavorably located blast nozzles which are, for example, only half covered by the label edge can be prevented by adjusting the slide and the air-blast unit, respectively.
- the adaptability of the air-blast labeling device to more complicated operating conditions is possible, e.g. labeling at low temperatures or high humidity, which can each lead to a deterioration in the adhesive properties, can be compensated by a concentrated increase in the air-injection energy.
- necessary corrections of the flight path, e.g. on account of curves in the label due to the winding onto the dispensing roller or on account of an off-center position of the blast nozzles, can be corrected by means of adjustment of the slide. As a result, an exactly predeterminable placing of the label on the package is achieved.

BRIEF DESCRIPTION OF THE DRAWINGS

These and further advantages of the invention will be explained in greater detail in the following on the basis of the description and the figures. The figures show in detail.

SPECIFIC DESCRIPTION

Figure 1:
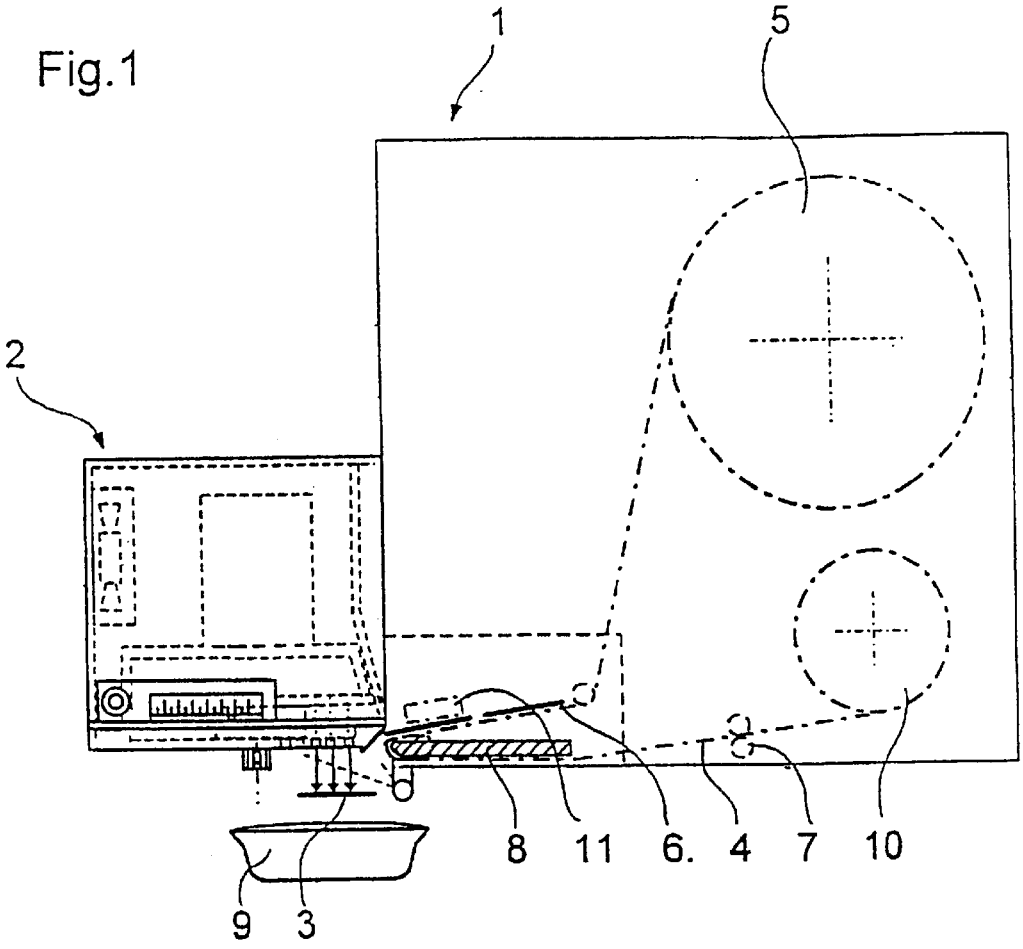
FIG. 1 a side view of an inventive labeling apparatus with an air-blast labeling device and a label dispensing device.

FIG. 1 illustrates a labeling apparatus with a label dispensing device 1 and an air-blast labeling device 2 secured thereto. The label dispensing device 1 which is known per se operates in the present embodiment with self-adhesive labels 3 which adhere to a backing strip 4 and are wound on a label dispensing roller 5. The backing strip is transported along a label path 6. As a result of a strong deflection of the label path 6 under tractive force by means of drive rollers 7 about a removal bar 8 the label 3 to be applied to a package or article 9 is separated from the backing strip 4 which is subsequently wound on a backing strip roller 10. The label dispensing device 1 can, when required, have an additional printer 11 for printing variable data on the labels.

The air-blast labeling device 2 takes over the label 3 supplied from the label dispensing device 1 and subsequently blows it automatically onto the package 9 which is supplied via a transport device which is not illustrated. The synchronization between the label dispensing device 1 with printer 11, the airblast labeling device 2 and the transport device is accomplished in a known manner via a process control with sensor elements which is not illustrated.

Figure 2:
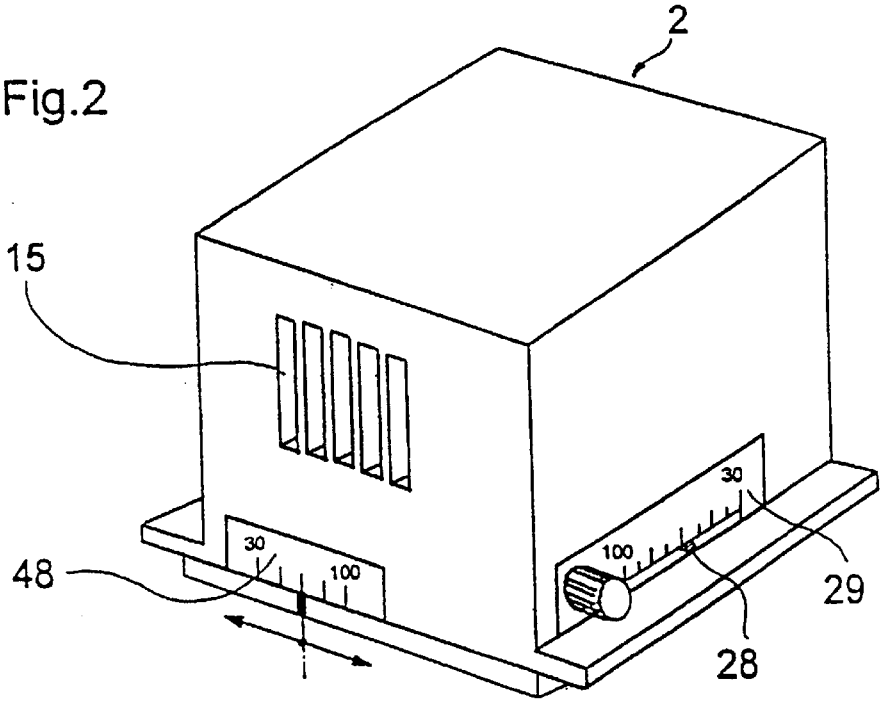
FIG. 2 a perspective illustration of the air-blast labeling device without a label dispensing device.
Figure 3:
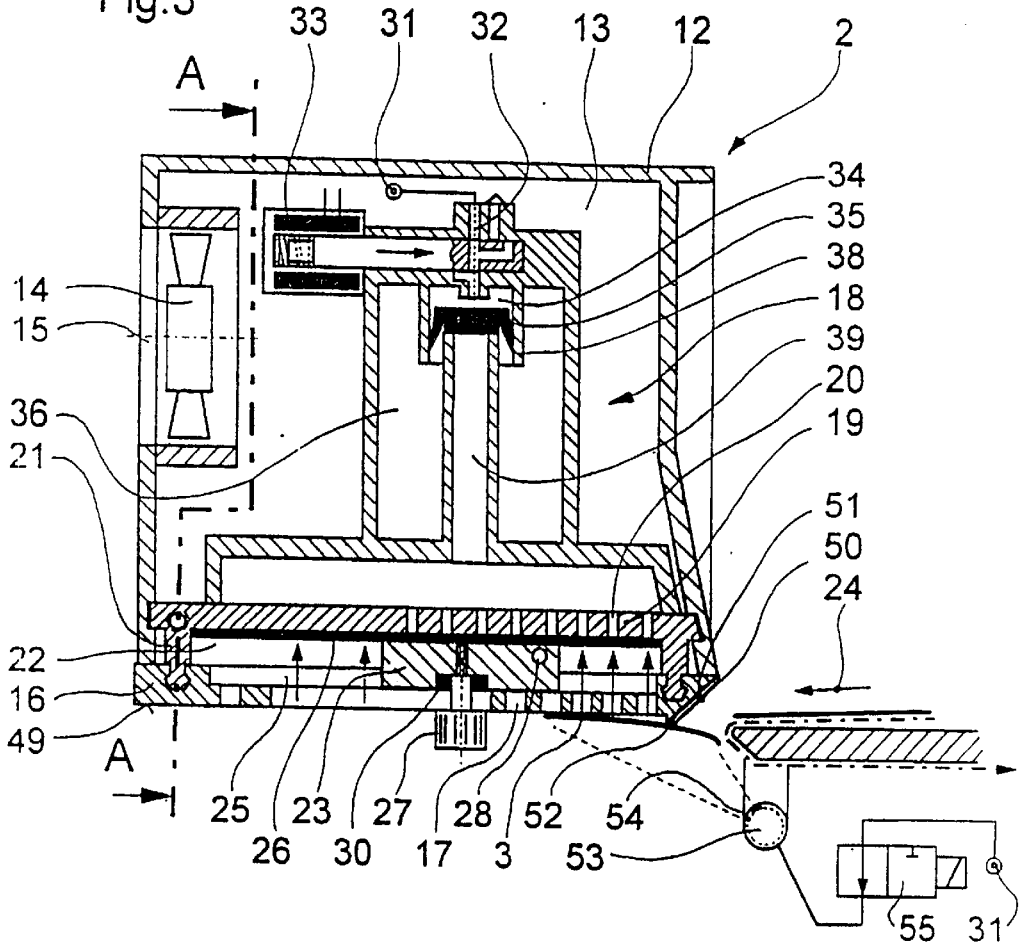
FIG. 3 a sectional view of the air-blast labeling device in accordance with FIG. 1, in the label drawing-in function.

The inventive air-blast labeling device 2 is, as is apparent from FIGS. 2 and 3, provided with a housing 12, the interior 13 of which is kept at a specific underpressure in relation to the surrounding atmospheric pressure by means of a ventilator 14 and the air conveyed to the outside by this ventilator via ventilating slits 15. A suction plate 16 for taking over the labels 2 is formed at the underside of the housing 12 and this has several suction openings 17 designed as bores and/or slits.

The suction plate 16 is set slightly lower with its label suction plane 49 than the dispensing position defined by the removal bar 8 of the label dispensing device 1. The side face of the suction plate 16 adjoining the label dispensing device is designed as an inclined sliding surface 50 for the labels 3 and provided with a plurality of elevations 51 which have the shape of saw teeth, extend in label dispensing direction 24 and continue as far as a peeling edge 52. This projects slightly beyond the suction plane 49.

During the removal procedure, the label 3 detached from the backing strip 4 at the removal bar 8 slides first of all with its front edge along the inclined sliding surface 50 and is deflected slightly downwards in its removal direction by the peeling edge 52 following the inclined sliding surface so that it travels at an acute angle to the suction plane 49 beneath the suction plate 16.

During the removal procedure a flow of air is blown against the underside of the label 3 by a support air pipe 53 arranged below the suction plane 49 through fine blast nozzles 54. This causes the label 3 to abut on the suction plate 16 and prevents the label from falling off during its transfer to the suction plate 16. The support air pipe 53 is connected to a compressed-air generator 31 via a two-way solenoid valve 55. The compressed air for the support air pipe 53 is advantageously switched on only during the label removal procedure. As a result, troublesome turbulences are avoided during the subsequent blowing off of the label and, moreover, compressed air saved.

After termination of the removal procedure the label 3 can still adhere lightly to the backing strip 4 with its end facing towards the removal bar 8. The peeling edge 52 and the blast force acting from the support air pipe 53 cause the label to tilt about the peeling edge 52 in relation to the suction plate 49 while the rear label edge is detached from the backing paper at the same time.

Figure 5:
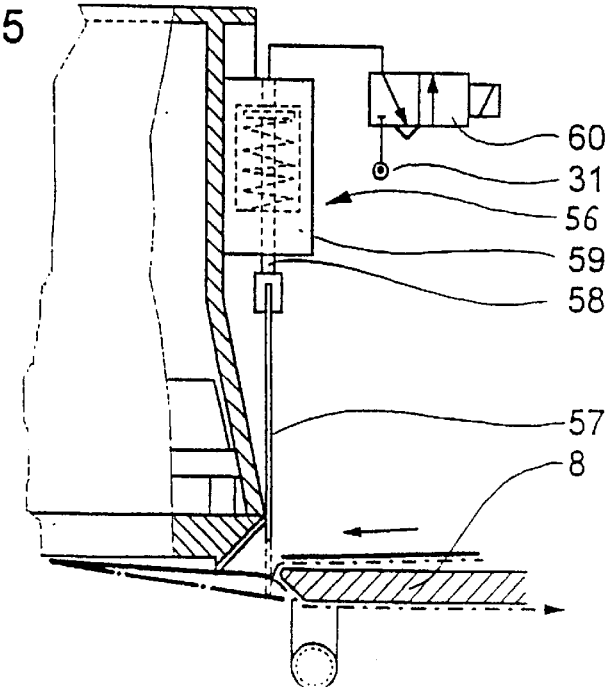
FIG. 5 a partial view of the air-blast labeling device in accordance with FIG. 3 with additional label ejector.

Normally, this detaching function is completely adequate. In the case of labels of poorer quality individual detachment problems can, however, still occur despite the above measures. For this purpose, an additional ejector 56 can be used as an option, as illustrated in FIG. 5.

A spring plate plunger 57 is arranged between label removal bar 8 and inclined sliding surface 50 of the suction plate 16 and this is securely connected to the piston rod 58 of a compressed-air cylinder 59 attached to the air-blast labeling housing 12 and acting to one side. The compressed-air cylinder 59 is connected to the compressed-air generator 31 via a solenoid valve 60.

Immediately after the label removal procedure is terminated, the solenoid valve 60 is switched over for a short time. The spring plate plunger 57 thereby carries out a short thrusting movement onto the end of the label at right angles to the label dispensing direction 24 and causes its reliable detachment from the backing strip. Immediately thereafter the spring plate plunger returns to its initial position.

A self-contained air-blast unit 18 is accommodated in the interior of the air-blast labeling housing 12 and securely connected to the suction plate 16. The side of the air-blast unit 18 facing the suction plate 16 is designed as an air-blast plate 19 with blast nozzles 20 and arranged parallel to the suction plate 16, forming a space 22 via spacer members 21.

The position of the blast nozzles 20 in the air-blast plate 19 is congruent with the position of the suction openings 17 in the suction plate 16, wherein the suction openings 17 are larger than the diameters of the blast nozzles 20. As a result, the flow of air exiting from the individual blast nozzles and propagating in a cone shape can move through the suction openings 17 in an unhindered manner. The label drawing-in function is not impaired by this because the relatively large air conveyance capacity of the ventilator 14 allows greater suction cross sections.

A closure element in the form of a flat slide 23 is arranged between the suction plate 16 and the air-blast plate 19 and its thickness dimension corresponds to the height of the space 22. The flat slide 23 is displaceable in the label dispensing direction 24 and guided laterally in a groove 25 of the suction plate 16.

In addition, a fine-meshed screen 26 is inserted between the air-blast plate 19 and the flat slide 23 and this covers all the blast nozzles 20 and its mesh screen spacing is at the most one third of the diameter of the blast nozzles. Alternatively hereto, the screen 26 can also be arranged on the side of the air-blast plate 19 located opposite the flat slide 23. The fine-meshed screen 26 has the effect that the differences in the flow of air between the individual blast nozzles 20 are compensated, a uniform overall flow of air acts on the label 3 and this is moved towards the package 9 without any curves. The straightness of the label flight path is thereby improved and the formation of folds in the label 3 when "landing" on the package surface is avoided.

The adjustment of the flat slide 23 in label dispensing direction 24, in accordance with the length of the label, is made possible via a handle 27 which is secured to the flat slide 23 and projects outwardly through a slot in the suction plate 16. The position of the flat slide 23 in label dispensing direction 24 is indicated by an indicator 28 which is secured to the flat slide 23 and visible from the outside. It serves for manually setting the length of the label which is being processed by means of a scale 29 attached to the housing 12. An additional spring element 30 is arranged so as to be sunk in the flat slide 23 and abut resiliently on the suction plate 16, this spring element acting as a friction brake against the self-acting adjustment of the flat slide and at the same time pressing the flat slide 23 against the screen 26 and the air-blast plate 19 and thus sealing all the blast nozzles 20 located within the surface of the flat slide.

In the following, the parts located above the air-blast plate 19 will be described in greater detail.

Figure 4:
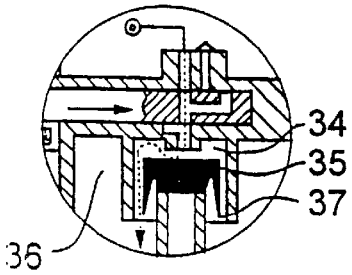
FIG. 4 a partial view of the air-blast labeling device in accordance with FIG. 3 during filling of the pressure storage chamber.

The air-blast unit 18 is connected to the supply of compressed air available to the user via a filter/regulator unit not illustrated in the drawings. The compressed-air generator 31 can also be integrated in the air-blast labeling housing 12. A permanent overpressure is applied via a compressed-air connection 33. In the filling position shown in FIG. 4, a three-way solenoid valve 33 causes the compressed air to flow into a membrane chamber 34 and past a resiliently yielding pot-shaped membrane 35 into a pressure storage chamber 36 until the pressure preset in the chambers 34 and 36 of the regulator unit is built up. At the same time, the pot-shaped membrane 35 seals an air-injection bore 39. As is apparent in FIG. 3, elastic lips 37 of the pot-shaped membrane 35 then abut on the membrane chamber wall 38 due to their inherent tension.

Figure 6:
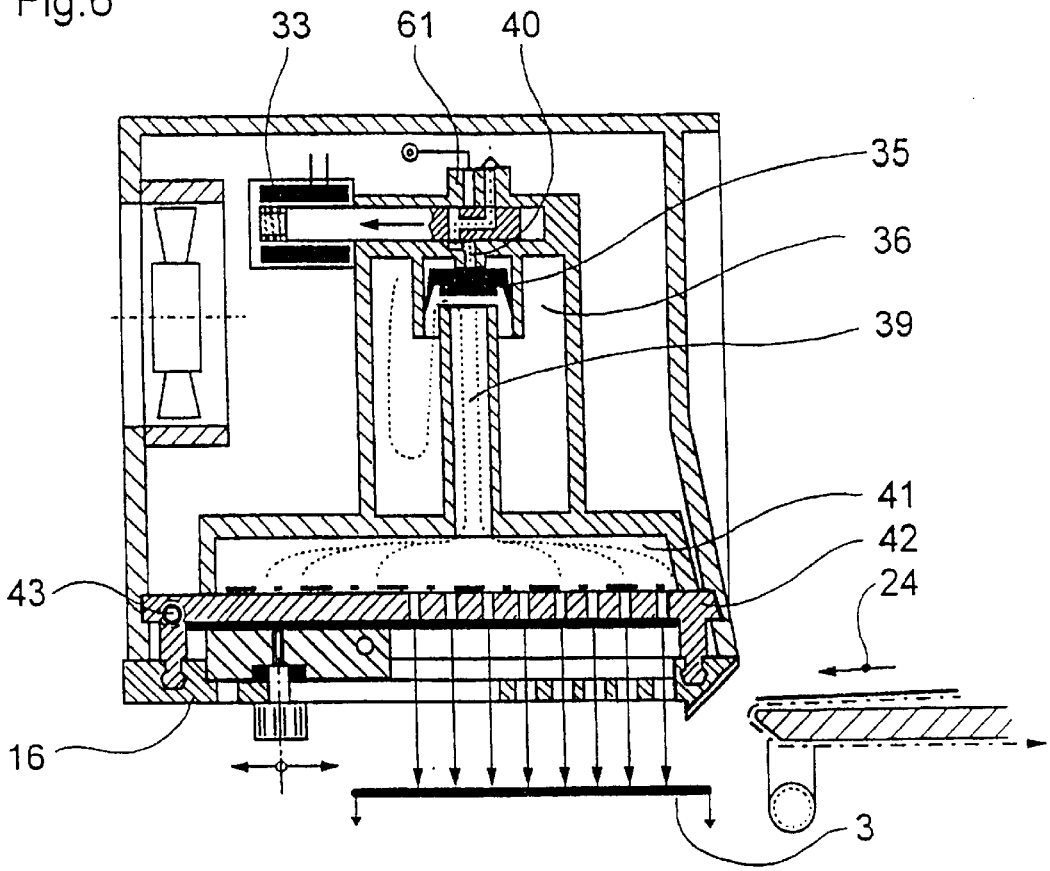
FIG. 6 a sectional view in accordance with FIG. 3 in the label blow-off function.

During the switchover into the second position of the solenoid valve 33, as shown in FIG. 6, the membrane chamber 34 is ventilated via a rapid ventilation bore 40. The pressure acting from the pressure storage chamber 36 on the pot-shaped membrane 35 presses this very quickly upwards, at the same time sealing the rapid ventilation bore 40 and releasing the air-injection bore 39. The compressed air stored in the pressure storage chamber 36 is thereby discharged abruptly through the air-injection bore 39 into the distributor chamber 41 and generates a burst of compressed air through the blast nozzles 20 onto the label 3 lying ready on the suction plate 16 and blows it onto the package 9. Immediately following this pulse of compressed air, which leads to the label 3 being blown onto the package 9 within a few milliseconds after the switchover of the solenoid valve 33, the solenoid valve 33 can be switched back into its initial position in accordance with FIGS. 3 and 4. The air-blast labeling device 2 can now take up the next label again from the label dispensing device 1.

The pressure storage chamber 36 with a valve member 61 and the distributor chamber 41 can be advantageously produced from one piece.

Figure 7:
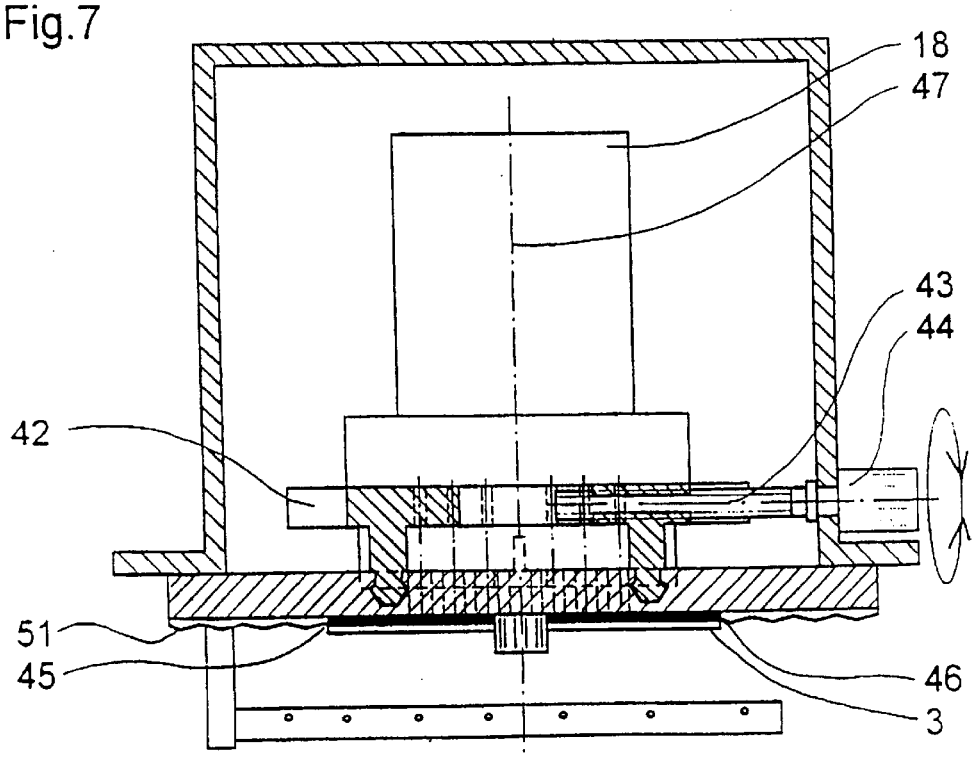
FIG. 7 a sectional view along line A—A in FIG. 3.

The complete air-blast unit 18 is adjustable transversely to the label dispensing direction 24. It is thereby guided in sliding guide grooves 42 which are inserted in the air-blast labeling housing 12. As is apparent from FIG. 7, the adjustment takes place by means of a threaded spindle 43 and a turning knob 44 located outside the air-blast labeling housing.

In the embodiment described here, the label dispensing device 1 is constructed such that during processing of different label widths the left label edge 45 always remains at the same position while the right label edge 46 varies in its position by the difference in label widths.

The transverse adjustment of the air-blast unit 18 is selected in the case of a symmetrical label shape such that the central axis 47 of the air-blast unit 18 is located centrally in relation to the label width of the label 3 issued by the label dispensing device 1. The set position of the label width is indicated at a scale 48 attached to the air-blast labeling housing 12.

Alternatively, the manual setting of the flat slide 23 in label dispensing direction 24 and of the air-blast unit 18 transversely to the label dispensing direction can also be carried out by a motor, e.g., via a stepping motor each which are not illustrated. The position data of the flat slide 23 and the air-blast unit 18 are stored in an article data memory of the central control unit in accordance with the label size (length×width) to be used for a specific article.

When changing to a new article, the new position data are called up, e.g., by entering the new article number together with other data specific to the article and the new position data for flat slide 23 and air-blast unit 18 are automatically set.

We claim:

1. Labeling apparatus for the application of labels to packages and goods comprising a label dispensing device and an air-blast labeling device, wherein the label dispensing device supplies labels individually from a supply to the air-blast labeling device and wherein the air-blast labeling device comprises a low-pressure chamber with a suction plate having a plurality of openings for drawing in the labels supplied by the label dispensing device, a source of compressed air with a compressed-air distributor having an air-blast plate arranged adjacent the suction plate and provided with a plurality of openings, as well as a compressed-air pulse generator directing a blast of compressed air from the source of compressed air through the air-blast plate of the compressed-air distributor and through the suction plate against the label held by the suction plate in order to release this from the suction plate and convey it to the package or article, said air-blast labeling device comprising between the suction plate and the air-blast plate a slide element mounted for displacement in such a manner that in various adjustment positions it covers or releases variable surface areas of the suction and air-blast plates for the passage of air drawn in or expelled.

2. Labeling apparatus as defined in claim 1, wherein the slide element is displaceable in label dispensing direction.

3. Labeling apparatus as defined in claim 1, wherein the slide element is a flat slide with a thickness dimension corresponding to the height of the space between suction plate and air-blast plate.

4. Labeling apparatus as defined in claim 1, wherein the slide element is adjustable in label dispensing direction by means of a handle arranged below the suction plate and that a spring element acting as a friction brake against the self-acting adjustment of the slide element is present.

5. Labeling apparatus as defined in claim 1, wherein the source of compressed air including the air-blast plate is adjustable transversely to the label dispensing direction.

6. Labeling apparatus as defined in claim 5, wherein the source of compressed air is adjustable for adaptation to the label width by means of a threaded spindle and a turning knob located externally on the air-blast labeling device, wherein the set label width is readable at a scale arranged on the air-blast labeling device.

7. Labeling apparatus as defined in claim 1, wherein the adjustment position of the slide element in label dispensing direction is readable by way of an indicator secured to the slide element and visible from the outside, by means of a scale.

8. Labeling apparatus as defined in claim 1, wherein the adjustment of the slide element and/or of the source of compressed air takes place by way of a motor.

9. Labeling apparatus as defined in claim 8, wherein the adjustment position data of the slide element and the source of compressed air are stored in an article data memory per article in accordance with the label size (length×width) to be used and with entry of a new article the adjustment positions of the slide element and the source of compressed air are approachable automatically in accordance with the new position data.

10. Labeling apparatus as defined in claim 1, wherein the slide element abuts sealingly on the air-blast plate under tension.

11. Labeling apparatus as defined in claim 1, wherein the openings of the air-blast plate are blast nozzles and are aligned with the openings of the suction plate.

12. Labeling apparatus as defined in claim 11, wherein the width of the openings in the suction plate is greater than the diameter of the blast nozzles.

13. Labeling apparatus as defined in claim 1, wherein the openings of the air blast plate are blast nozzles, and wherein a fine-meshed screen is arranged between the slide element and the air-blast plate and covers all the blast nozzles and its mesh screen spacing is at the most one third of the diameter of the blast nozzles.

14. Labeling apparatus as defined in claim 1, wherein a fine-meshed screen is arranged on the side of the air-blast plate remote from the slide element.

15. Labeling apparatus as defined in claim 1, wherein the side face of the suction plate pointing towards the label dispensing device is designed as an inclined sliding surface for the labels and a peeling edge projecting beyond the suction plane is adjoined thereto.

16. Labeling apparatus as defined in claim 15, wherein the inclined sliding surface is provided with a plurality of ribs extending in label dispensing direction and continuing as far as the peeling edge.

17. Labeling apparatus as defined in claim 1, wherein a support air pipe with fine blast nozzles is arranged beneath the label suction plane for directing a flow of air in the direction of the suction plate, wherein the support air pipe is suppliable with compressed air via a valve as required.

18. Labeling apparatus as defined in claim 1, wherein a movable ejector is arranged between a label removal bar of the label dispensing device and the suction plate for carrying out a short thrusting movement at right angles to the label dispensing direction upon termination of a label removal procedure.

19. Labeling apparatus as defined in claim 1, wherein the openings of the air blast plate are blast nozzles, and wherein the source of compressed air comprises a pressure storage chamber immediately adjacent to the air-blast plate, said chamber being ventilated abruptly via a valve, wherein the pressure energy stored in the pressure storage chamber is releasable via a distributor chamber and through the blast nozzles as a pressure pulse.

20. Labeling apparatus as defined in claim 19, wherein the pressure storage chamber is produced in one piece with a valve member and the distributor chamber.

21. Labeling apparatus as defined in claim 20, wherein the pressure storage chamber contains an integrated membrane chamber with a pot-shaped membrane, wherein the pot-shaped membrane seals an air-injection bore leading to the blast nozzles during the filling of and maintaining the pressure in the pressure storage chamber and releases the air-injection bore and with it the connection between pressure storage chamber and blast nozzles during the switching over of the valve.

22. Labeling apparatus as defined in claim 19, wherein the pressure storage chamber contains an integrated membrane chamber with a pot-shaped membrane, wherein the pot-shaped membrane seals an air-injection bore leading to the blast nozzles during the filling of and maintaining the pressure in the pressure storage chamber and releases the air-injection bore and with it the connection between pressure storage chamber and blast nozzles during the switching over of the valve.

* * * * *